US007996927B2

(12) United States Patent
Mahler

(10) Patent No.: US 7,996,927 B2
(45) Date of Patent: Aug. 16, 2011

(54) DISCHARGE VALVE FOR A FLUSHING CISTERN

(75) Inventor: Alfred Mahler, Rüti (CH)

(73) Assignee: Geberit Technik AG, Jona (CH)

( * ) Notice: Subject to any disclaimer, the term of this patent is extended or adjusted under 35 U.S.C. 154(b) by 441 days.

(21) Appl. No.: 12/132,251

(22) Filed: Jun. 3, 2008

(65) Prior Publication Data

US 2008/0313797 A1 Dec. 25, 2008

(30) Foreign Application Priority Data

Jun. 19, 2007 (EP) ..... 07405176

(51) Int. Cl.
*E03D 1/14* (2006.01)
*E03D 3/12* (2006.01)

(52) U.S. Cl. ..... 4/325

(58) Field of Classification Search ..... 4/324–327, 4/345, 378–382, 384, 391; 137/423, 426, 137/430, 434
See application file for complete search history.

(56) References Cited

U.S. PATENT DOCUMENTS 5,331,690 A * 7/1994 Pourcier ..... 4/410
5,657,494 A * 8/1997 Diethelm ..... 4/324
6,094,753 A * 8/2000 Korte ..... 4/325
2006/0248638 A1* 11/2006 Diethelm et al. ..... 4/378

FOREIGN PATENT DOCUMENTS

EP 1 672 130 A1 6/2006

* cited by examiner

*Primary Examiner* — Gregory L Huson
*Assistant Examiner* — Janie Christiansen
(74) *Attorney, Agent, or Firm* — Sughrue Mion, PLLC

(57) ABSTRACT

The discharge valve has a valve housing (14) which has an outlet opening with a valve seat (16) and also a closure body (12). A two-quantity actuator (4) has a connecting rod (10) which is connected to the closure body (12) and by means of which the closure body (12) can optionally be raised by different displacement distances. A top activatable partial-quantity float (13) is provided for partial flushing and a bottom, full-quantity float (20), which is mounted in a pivotable manner on the valve housing (14), is provided for full flushing. The full-quantity float (20) has a blocking element (22) which, once partial flushing has been triggered, engages with the closure body (12) and blocks the latter against further displacement. This prevents the situation where, once partial flushing has been triggered, the closure body (12) is raised further and full flushing takes place.

9 Claims, 2 Drawing Sheets

DISCHARGE VALVE FOR A FLUSHING CISTERN

Figure 1:
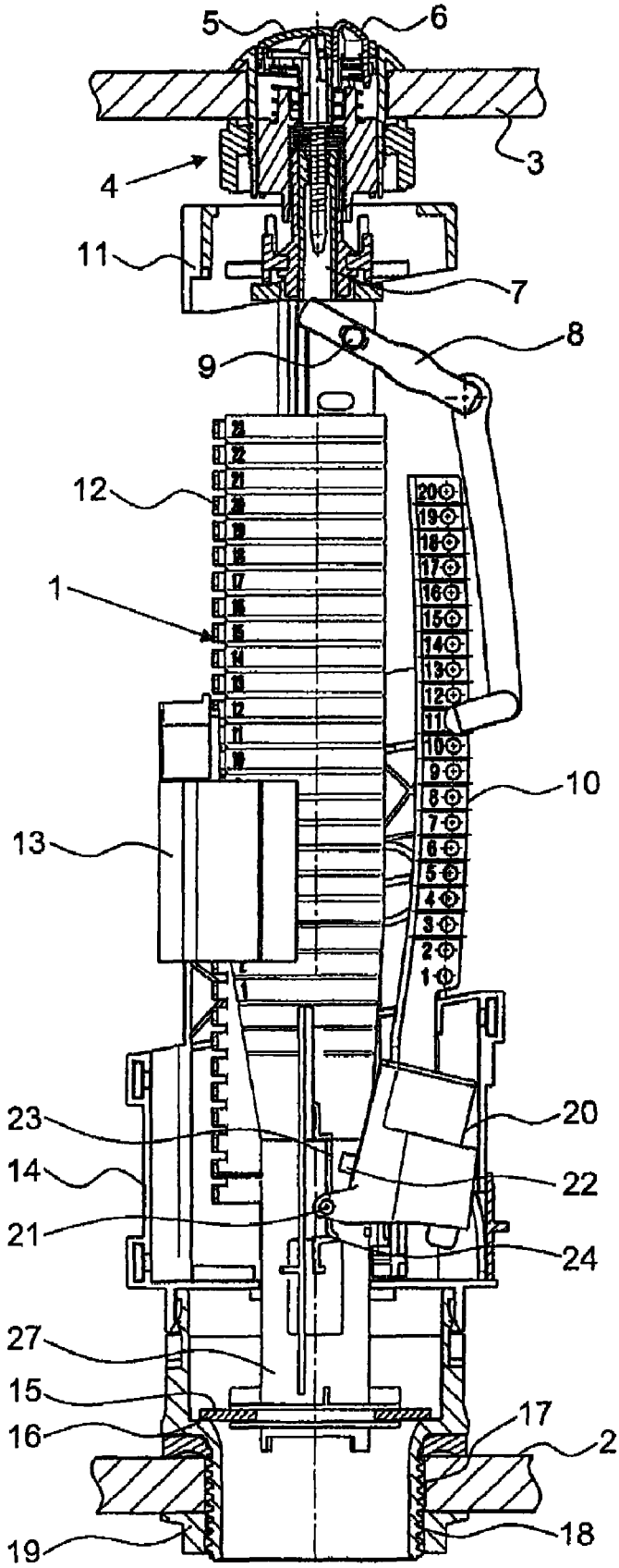

The invention relates to a discharge valve for a flushing cistern, having a valve housing which has an outlet opening with a valve seat, having a closure body which interacts with the valve seat at a bottom end, having a two-quantity actuator which has a connecting rod which is connected to the closure body and by means of which the closure body can optionally be raised by different displacement distances, having a top activatable partial-quantity float for partial flushing, and having a bottom, full-quantity float which is mounted in a pivotable manner on the valve housing and is intended for full flushing.

A discharge valve of this type has been disclosed in the prior art in the applicant's EP-A-1 672 130. In this document, the full-quantity float is mounted such that it can be pivoted about a stationary axial element, and it fixes the closure body counter to gravitational force once this closure body has been raised by a long triggering displacement distance. The full-quantity float releases the closure body only after essentially all the flushing water has been discharged. In the case of a shorter triggering displacement distance for triggering partial-quantity flushing, the full-quantity float uses an integrally formed nose to prevent the closure body from being raised beyond this displacement distance. Once the envisaged partial quantity has been discharged, then the partial-quantity float subjects the closure body to loading and the closure body thus drops onto the valve seat and interrupts flushing.

It has been found that it is sometimes the case in practise, despite the abovementioned nose on the full-quantity float, that, once partial-quantity flushing has been triggered, the closure body is raised yet further by the water buoyancy and is finally fixed to the full-quantity float. Instead of partial-quantity flushing, full-quantity flushing thus takes place here, which means that an unnecessary amount of water is consumed.

The object of the invention is to provide a discharge valve of the abovementioned type by means of which partial-quantity flushing can be carried out more reliably and unnecessary water consumption can thus be avoided. The abovementioned malfunctioning should thus be reliably avoided.

The object is achieved in the case of a discharge valve of the generic type according to claim 1. In the case of the discharge valve according to the invention, the connecting rod blocks the full-quantity float once partial-quantity flushing has been triggered. It not only prevents premature closure of the valve once full-quantity flushing has been triggered but also, by the blocking action of the connecting rod, prevents, in a yet more reliable manner than has been the case up until now, the situation where the closure body is raised further, and undesired full-quantity flushing thus takes place, once partial-quantity flushing has been triggered. The functional reliability in the case of partial-quantity flushing can thus be significantly increased by way of cost-effective development of comparatively straightforward design. The operations of triggering partial flushing and full flushing can be carried out as they have been previously. It is thus possible to use a previously known two-quantity actuator for example according to the abovementioned EP-A-1 672 130. It is likewise also possible to set the partial-flushing quantity by adjusting the partial-quantity float.

According to a development of the invention, it is provided that the closure body has a guide means with which the full-quantity float interacts in order to block further displacement. Such a suitable guide means can be realized without any further outlay. A particularly reliable design solution to the abovementioned object can be realized when, according to a development, the blocking element is a protruberance which is arranged on the full-quantity float. In particular this protruberance is integrally formed on the full-quantity float. This can be realized without any significant further outlay.

According to a development of the invention, the guide means has a horizontally extending shoulder against which the blocking element butts, and thus blocks further displacement, once partial flushing has been triggered.

According to a development of the invention, it is provided that the connecting rod blocks the full-quantity float in a predetermined pivoting position once partial-quantity flushing has been triggered. The above-mentioned blocking means can thus be designed in a particularly reliable manner. The full-quantity float even provides reliable blocking when, as has been the case up until now, it is produced with a comparatively low level of buoyancy. There is thus no need for the full-quantity float to be larger than has been the case up until now.

According to a development of the invention, it is provided that a retaining protruberance is arranged on the connecting rod, this retaining protruberance acting on the full-quantity float once partial-quantity flushing has been triggered. This allows straightforward and nevertheless automatic and reliable fixing of the closure body once partial-quantity flushing has been triggered. This can be achieved particularly straightforwardly, and nevertheless reliably, in design terms by the retaining protruberance, according to a development of the invention, engaging behind part of the full-quantity float.

Further advantageous features can be gathered from the dependent patent claims, from the following description and from the drawing.

Figures 2A, 2B, 2C, 2D:
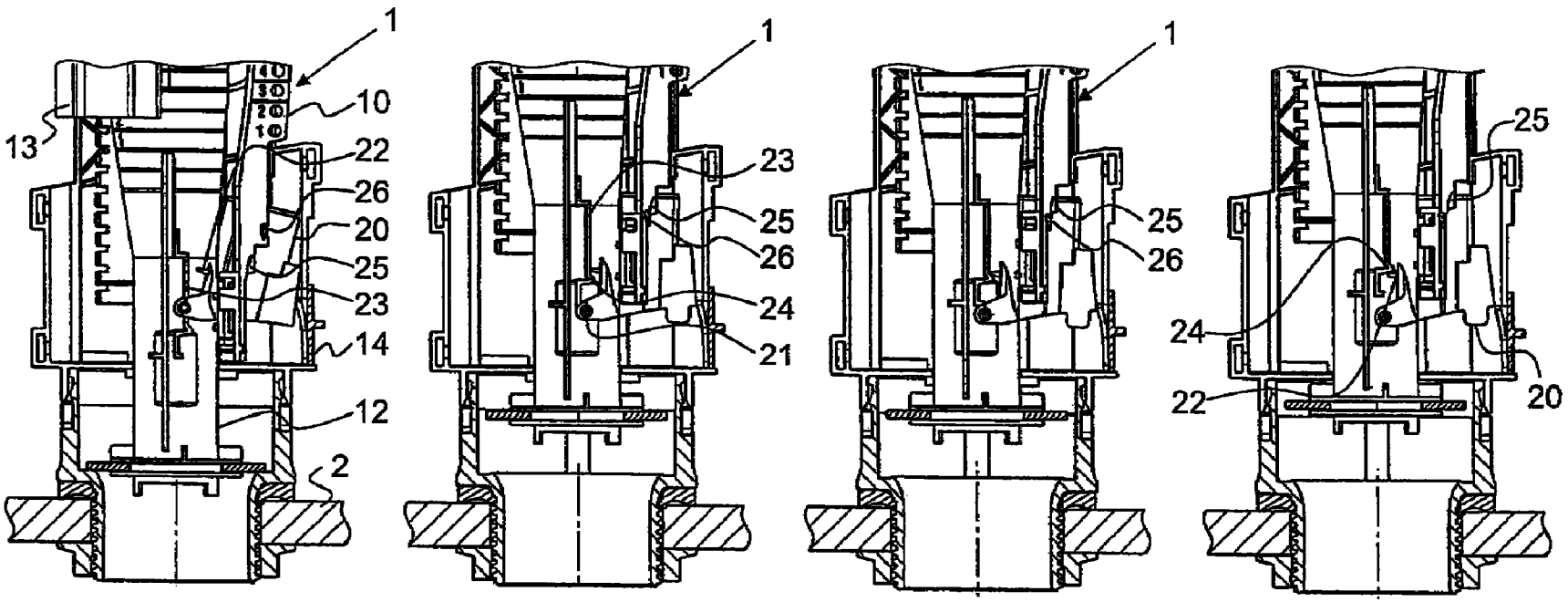

An exemplary embodiment of the invention will be explained in more detail hereinbelow with reference to the drawing, in which:

FIG. 1 shows a partially sectional view of a discharge valve according to the invention, FIG. 2*a* shows a partially sectional view of part of the discharge valve according to the invention in its rest position according to FIG. 1, parts of the full-quantity float having been eliminated for illustrative reasons, FIG. 2*b* shows an illustration according to FIG. 2*a*, but with the closure body raised partially following triggering of partial-quantity flushing, FIG. 2*c* shows an illustration according to FIG. 2*a*, but with the closure body raised fully following triggering of partial-quantity flushing, and FIG. 2*d* shows an illustration according to FIG. 2*a*, but with the closure body raised fully following triggering of full-quantity flushing.

FIG. 1 shows the discharge valve 1 according to the invention in a flushing cistern 2 for a WC. The flushing cistern 2 has, as usual, an opening 17 into which a connector 18 of a valve housing 14 has been inserted. On the underside of the flushing cistern 2, the connector 18 has been fixed by a nut 19.

The valve housing 14 forms, as usual, a valve seat 16 with which a closure body 12 interacts, this closure body having an elastomeric valve disc 15 at a bottom end 27. The valve housing 14 has, as usual, windows (not presented any more specifically here) through which, when the valve is open, flushing water (not shown here) can flow through the connector 18 into the connected WC (not shown here).

The flushing cistern 2 has a removable cover 3 in which is mounted an actuator 4 which has a button 5 for triggering full-quantity flushing and a further button 6 for triggering partial-quantity flushing. The actuator 4 can thus optionally be used to trigger partial flushing or full flushing. Full flushing uses, for example, 6 litres and partial flushing uses 3 litres. However, other flushing quantities, of course, are also possible. Instead of the buttons 5 and 6, it is also possible to use other triggering elements. For example contactless actuation would also be conceivable in principle.

The actuator 4 is connected to a yoke 11 and has a push rod 7 by means of which a two-armed lever 8 can be pivoted about a pin 9. The pivoting movement of the lever 8 is transmitted to a connecting rod 10 which is connected to the closure body 12. If the button 6 is pushed, then the closure body 12 is raised by a short displacement distance. When the button 5 is pushed, the closure body 12 is raised by a greater displacement distance. FIG. 2*b* shows the displacement following triggering of partial-quantity flushing and FIG. 2*d* shows the displacement following triggering of full-quantity flushing.

Once partial-quantity flushing has been triggered, a partial-quantity float 13 is coupled to the closure body 12 in a manner which is known per se. This float keeps the closure body 12 in the position which is shown in FIG. 2*b* until the level of the flushing water in the flushing cistern 2 has reached a predetermined partial-quantity water line. Once the water level drops below this water line, the partial-quantity float 13 subjects the closure body 12 to loading and the closure body then drops immediately into the closing position, which is shown in FIG. 2*a*. A comparatively large quantity of the flushing water then still remains in the flushing cistern 2.

In order for it not to be possible for the closure body 12 to move further upwards in the case of partial-quantity flushing, the guide means 23 which is shown in FIGS. 1 and 2*a*-2*d* is integrally formed at the bottom end 27 of the closure body 12. This guide means has a shoulder 24 which extends, as can be seen, horizontally. The guide means 23 runs essentially vertically above this shoulder 24. A blocking element 22 in the form of a protruberance or nose is arranged on the full-quantity float 20, at a distance above the pivot pin 21. If the closure body 12 is raised into the position which is shown in FIG. 2*b*, then this blocking element 22 is located directly above this shoulder 24. If the closure body 12 is raised yet further, this is prevented by the blocking element 22 striking against the shoulder 24. The blocking element 22 is pressed onto the guide means 23 by the buoyancy of the full-quantity float 20. In order for the closure body 12 to be raised further beyond the position which is shown in FIG. 2*c*, the full-quantity float 20 would thus have to be pivoted in the clockwise direction counter to its buoyancy force. In order for such a pivoting movement to be reliably prevented, the buoyancy of the full-quantity float 20 could be increased by the float being correspondingly enlarged. As an alternative, according to the embodiment shown, a retaining protruberance 25 may be integrally formed at the bottom end of the connecting rod 10, this retaining protruberance engaging behind part 26 of the full-quantity float 20 according to FIG. 2*b*. The retaining protruberance 25, in the position which is shown in FIG. 2*b*, thus prevents the full-quantity float from being able to be pivoted in the clockwise direction out of the blocking position shown. It is thus the case that the blocking action of the full-quantity float 20 cannot be eliminated even by the closure body 12 being subjected to a pronounced force in the upward direction. The closure body 12 thus inevitably remains in the position which is shown in FIG. 2*b*.

In the case of a long displacement distance for full-quantity flushing, the closure body 12 is raised by the connecting rod 10 into the position which is shown in FIG. 2*d*. The blocking element 22 slides downwards along the guide means 23 as far as the shoulder 24, as FIG. 2*c* shows. The protruberance 25 is then located above the part 26 and thus no longer performs any blocking action. It is thus possible, as the closure body 12 is raised further, for the blocking element 22 to run round the shoulder 24 as a result of a corresponding pivoting movement in the clockwise direction, and it finally passes into the position which is shown in FIG. 2*d*. In this position, the blocking element 22 engages beneath the shoulder 24. This position is maintained by the buoyancy of the full-quantity float 20. If the level of the flushing water drops to the full-quantity water line, which is located beneath the full-quantity float 20, then the buoyancy of the full-quantity float 20 dissipates and this float, as a result of its own weight, pivots in the clockwise direction into the position which is shown in FIG. 2*a*. The closure body 12 is thus no longer supported by the full-quantity float 20, and it drops downwards onto the valve seat 16. The flushing cistern 2 is then filled with flushing water again through an inlet valve (not shown here). The flushing cistern is thus ready, once again, for further flushing.

LIST OF DESIGNATIONS

1 Discharge valve
2 Flushing cistern
3 Flushing-cistern cover
4 Actuator
5 Button (full-quantity flushing)
6 Button (partial-quantity flushing)
7 Push rod
8 Lever
9 Pivot pin
10 Connecting rod
11 Yoke
12 Closure body
13 Partial-quantity float
14 Valve housing
15 Valve disc
16 Valve seat
17 Opening
18 Connector
19 Nut
20 Full-quantity float
21 Pivot pin
22 Blocking element
23 Guide means
24 Shoulder
25 Retaining protruberance
26 Part
27 Bottom end (closure body)

The invention claimed is:

1. A discharge valve for a flushing cistern, having a valve housing which has an outlet opening with a valve seat, having a closure body which interacts with the valve seat at a bottom end, having a two-quantity actuator which has a connecting rod which is connected to the closure body and by means of which the closure body can optionally be raised by different displacement distances, having a top activatable partial-quantity float for partial flushing, and having a bottom, full-quantity float which is mounted in a pivotable manner on the valve housing and is intended for full flushing, which full-quantity float has a blocking element which, once partial flushing has been triggered, engages with the closure body and blocks the latter against further displacement, wherein the connecting rod blocks the full-quantity float in a predetermined pivoting position once partial-quantity flushing has been triggered.

2. The discharge valve according to claim 1, wherein the closure body has a guide means with which the full-quantity float interacts in order to block further displacement of the closure body.

3. The discharge valve according to claim 1, wherein the blocking element is a protuberance or nose which is arranged, and in particular integrally formed, on the full-quantity float.

4. The discharge valve according to claim 2, wherein the guide means has an approximately horizontally extending shoulder against which the blocking element butts, and thus blocks further displacement, once partial flushing has been triggered.

5. The discharge valve according to claim 1, wherein a retaining protuberance is arranged on the connecting rod, this retaining protuberance acting on the full-quantity float once partial-quantity flushing has been triggered.

6. The discharge valve according to claim 5, wherein the retaining protuberance of the connecting rod engages behind part of the full-quantity float and thus fixes the full-quantity float in its blocking position.

7. The discharge valve according to claim 6, wherein the retaining protuberance can be moved upwards out of the abovementioned blocking position, and this unblocks the full-quantity float.

8. The discharge valve according to claim 1, wherein once full-quantity flushing has been triggered, the blocking element, which is arranged on the full-quantity float, couples the full-quantity float to the closure body and keeps the same in the raised position during full-quantity flushing.

9. The discharge valve according to claim 1, wherein the two-quantity actuator has a push rod by means of which the closure body can optionally be made to execute a short displacement or a long displacement.

* * * * *